US006204235B1

(12) United States Patent
Jimenez Carrillo et al.

(10) Patent No.: US 6,204,235 B1
(45) Date of Patent: Mar. 20, 2001

(54) ACTIVE CHLORINE PREPARATIONS CONTAINING STABILIZED OPTICAL BRIGHTENERS

(75) Inventors: Lidia Jimenez Carrillo, Terrassa; Mercedes Mendoza Cruz; Miguel Osset Hernandez, both of Barcelona, all of (ES)

(73) Assignee: Henkel Kommanditgesellschaft Auf Aktien, Duesseldorf (DE)

( * ) Notice: Subject to any disclaimer, the term of this patent is extended or adjusted under 35 U.S.C. 154(b) by 0 days.

(21) Appl. No.: 09/452,537

(22) Filed: Dec. 1, 1999

(30) Foreign Application Priority Data

Dec. 1, 1998 (DE) ..... 198 55 329

(51) Int. Cl.[7] ..... C11D 3/00; C11D 3/395; C11D 7/54; C11D 17/08

(52) U.S. Cl. ..... 510/379; 510/307; 510/394; 510/516

(58) Field of Search ..... 510/379, 307, 510/394, 516

(56) References Cited

U.S. PATENT DOCUMENTS 3,666,680 * 5/1972 Briggs ..... 252/316
4,708,816 * 11/1987 Chang et al. ..... 252/186.25
5,057,236 * 10/1991 Petrin et al. ..... 252/79.1
5,733,763 * 3/1998 Markussen et al. ..... 435/175

FOREIGN PATENT DOCUMENTS 0 622 451 11/1994 (EP) .

OTHER PUBLICATIONS

Jorn. Com. Esp.Deterg.27, (1997), pp. 213–220.

* cited by examiner

*Primary Examiner*—Yogendra Gupta
*Assistant Examiner*—John M Petruncio
(74) *Attorney, Agent, or Firm*—Wayne C. Jaeschke; Glenn E.J. Murphy

(57) ABSTRACT

An active chlorine composition is presented containing an active chlorine and an optical brightener, where the optical brightener is in the form of a microcapsule. The microcapsules are stable in the active chlorine composition and do not undergo decomposition or sedimentation.

23 Claims, No Drawings

ACTIVE CHLORINE PREPARATIONS CONTAINING STABILIZED OPTICAL BRIGHTENERS

BACKGROUND OF THE INVENTION

1. Field of the Invention

This invention relates generally to bleaching agents and disinfectants and, more particularly, to active chlorine preparations containing optical brighteners in microencapsulated form.

2. Discussion of Related Art

In Mediterranean countries and also in the United States, cold water is still predominantly used for washing laundry. The effect of this is that conventional bleaching agents, for example perborates or percarbonates, are hardly used because they do not develop any particular activity at temperatures around 20° C. For this reason, liquid bleaches—generally surface—active preparations containing up to 10% by weight of hypochlorite—are normally added to the wash liquor. Comparable preparations are also used for cleaning and disinfecting hard surfaces. An overview of hypochlorite liquors was published, for example, by J. Josa and M. Osset in Jorn. Corn. Esp. Deterg. 27, 213 (1997).

To counteract the yellowing of laundry, optical brighteners are added to the bleaching compositions. These auxiliaries are absorbed onto the fibers and convert invisible UV radiation into visible longer-wave light. The ultraviolet light absorbed from sunlight is re-emitted in the form of pale bluish fluorescence, i.e. in the complementary color to the yellowing. The optical brighteners used are generally dyes which are readily oxidized in a chlorine-containing environment and, as a result, lose their properties.

Microcapsules

"Microcapsules" are understood to be aggregates which contain at least one solid or liquid core surrounded by at least one continuous shell, more particularly a shell of polymer(s). They are normally finely dispersed liquid or solid phases coated with film-forming polymers, in the production of which the polymers are deposited onto the material to be encapsulated after emulsification and coacervation or interfacial polymerization. The microscopically small capsules, also known as nanocapsules, can be dried in the same way as powders. Besides single-core microcapsules, there are also multiple-core aggregates, also known as microspheres, which contain two or more cores distributed in the continuous shell material. In addition, single-core or multiple-core microcapsules may be surrounded by an additional second, third etc. Shell. Single-core microcapsules with a continuous shell are preferred. The shell may consist of natural, semisynthetic or synthetic materials. Natural shell materials are, for example, gum arabic, agar agar, agarose, maltodextrins, alginic acid and salts thereof, for example sodium or calcium alginate, fats and fatty acids, cetyl alcohol, collagen, chitosan, lecithins, gelatin, albumin, shellac, poly-saccharides, such as starch or dextran, sucrose and waxes. Semisynthetic shell materials are inter alia chemically modified celluloses, more particularly cellulose esters and ethers, for example cellulose acetate, ethyl cellulose, hydroxypropyl cellulose, hydroxypropyl methyl cellulose and carboxymethyl cellulose, and starch derivatives, more particularly starch ethers and esters. Synthetic shell materials are, for example, polymers, such as polyacrylates, polyamides, polyvinyl alcohol or polyvinyl pyrrolidone.

Although they may be produced in any shape, the microcapsules are preferably substantially spherical. Their diameter along their largest spatial dimension may be between 10 nm (visually not discernible as a capsule) and 10 mm, depending on the optical brighteners present in their interior and the application envisaged. Visible microcapsules between 0.1 mm and 7 mm and, more particularly, between 0.4 mm and 5 mm are preferred. Microcapsules invisible to the naked eye have a diameter of preferably 20 to 500 nm and more preferably 50 to 200 nm. The microcapsules may be obtained by known processes, of which coacervation and interfacial polymerization are the most important. Any commercially available surfactant-stable microcapsules may be used as the microcapsules, including for example the commercial products (the shell material is shown in brackets) Hallcrest Microcapsules (gelatin, gum arabic), Coletica Thalaspheres (maritime collagen), Lipotex Millicapsein (alginic acid, agar agar), Induchem Unispheres (lactose, microcrystalline cellulose, hydroxypropylmethyl cellulose), Unicerin C30 (lactose, micro-crystalline cellulose, hydroxypropylmethyl cellulose), Kobo Glycospheres (modified starch, fatty acid esters, phospholipids), Softspheres (modified agar agar) and Kuhs Probiol Nanospheres-(phospholipids).

The active substances are released from the microcapsules by mechanical, thermal, chemical or enzymatic destruction of the shell, normally during the use of the preparations containing the microcapsules. In the case of the bleaching agents normally used in undiluted form, they are preferably released by mechanical action, more particularly by mechanical forces to which the microcapsules are exposed during dosing, pump-circulation or spinning in the washing machine or during the cleaning and disinfection of hard surfaces. In one preferred embodiment of the invention, the preparations contain the same microcapsules or different microcapsules in quantities of 0.1 to 10% by weight, more preferably in quantities of 0.2 to 8% by weight and most preferably in quantities of 0.5 to 6% by weight.

Optical Brighteners

The optical brighteners which are used in microencapsulated form in accordance with the present invention are preferably those which are otherwise unstable in active chlorine preparations. Typical examples of suitable optical brighteners are derivatives of diaminostilbene disulfonic acid and alkali metal salts thereof. Suitable optical brighteners are, for example, derivatives of 4,4'-diamino-2,2'-stilbene disulfonic acid (flavonic acid), such as in particular the salts of 4,4'-bis-(2-anilino4-morpholino-1,3,5-triazinyl-6-amino)-stillbene-2,2'-disulfonic acid or compounds of similar structure which, instead of the morpholino group, contain a diethanolamino group, a methylamino group, an anilino group or a 2-methoxyethylamino group. Other brighteners which may be present are those of the substituted diphenyl styryl type, for example alkali metal salts of 4,4'-bis-(2-sulfostyryl)-diphenyl, 4,4'-bis-(4-chloro-2-sulfostyryl)-diphenyl or 4-(4-chlorostyryl)4'-(2-sulfostyryl)-diphenyl, methyl umbelliferone, coumarin, dihydroquinolinone, 1,3-diaryl pyrazoline, naphthalic acid amide, benzoxazole, benzisoxazole and benzimidazole systems linked by CH=CH bonds, heterocycle-substituted pyrine derivatives and the like. Mixtures of the brighteners mentioned above may also be used. The potassium salt of 4,4'-bis-(1,2,3-triazoly(2)-stilbine-2,2-sulfonic acid marketed under the name of Phorwite® BHC 766 is preferred. The microcapsules generally contain the optical brighteners in quantities of 1 to 75% by weight, preferably in quantities of 10 to 60% by weight and more preferably in quantities of 25 to 50% by weight, based on the weight of the capsules.

In addition, it is of advantage if, besides the usual brighteners in the usual quantities, for example between 1 and 5% by weight and preferably between 2 and 3% by weight, the microcapsules also contain small quantities of a blue dye. Particularly preferred brighteners or dyes are naphthotriazole stilbene sulfonic acid, for example in the form of its sodium salt (Tinopal® RBS 200) and tetrabenzotetraazaporphine (Tinolux® BBS), distyryl bisphenyl bis-(triazinylamino)-stilbene disulfonic acid (Tinopal® CDS-X) and, in particular, 4,4'-bis-(2-sulfostyrene)-biphenyl disodium salt (Tinopal® CBS-X, products of Ciba).

Sequestering agents

If the preparations are used for treating fabrics, it is advisable to add to them electrolytes which act as sequestrants for heavy metal ions and which therefore counteract yellowing of the fabrics. Suitable sequestering agents are, for example, silicates, phosphonic acids and phosphonates, polyacrylic acid compounds, alkali metal carbonates, such as sodium carbonate, lignin sulfonates and mixtures of the electrolytes mentioned. The total quantity of sequestrant used is normally 0.1 to 2% by weight, preferably 0.3 to 1.5% by weight and more preferably 0.5 to 1.0% by weight, based on the preparation.

Silicates in the context of the invention are understood to be salts and esters of orthosilicic acid $Si(OH)_4$ and self-condensation products thereof. Accordingly, the following crystalline substances, for example, may be used as silicates:

(a) neosilicates (island silicates) such as, for example, phenakite, olivine and zircon;

(b) sorosilicates (group silicates) such as, for example, thortveitite and hemimorphite;

(c) cyclosilicates (ring silicates) such as, for example, benitoite, axinite, beryl, milarite, osumilite or eudialyte;

(d) inosilicates (chain and band silicates) such as, for example, metasilicates (for example diopside) or amphiboles (for example tremolite);

(e) phyllosilicates (sheet and layer silicates) such as, for example, talc, kaolinite and mica (for example muscovite);

(f) tectosilicates (framework silicates) such as, for example, feldspars and zeolites and clathrasils or dodecasils (for example melanophlogite), thaumasite and neptunite.

In contrast to the ordered crystalline silicates, silicate glasses such as, for example, soda waterglass or potash waterglass are preferably used. These silicate glasses may be of natural origin (for example montmorillonite) or may have been produced by a synthetic route. In another embodiment of the invention, alumosilicates may also be used. Typical examples of alkali metal or alkaline earth metal silicates are sodium and/or potassium silicates with a modulus of 1.0 to 3.0 and preferably 1.5 to 2.0.

Phosphonic acids in the context of the invention are understood to be organic derivatives of the acid $HP(O)(OH)_2$; phosphonates represent the salts and esters of these phosphonic acids. The organic phosphonic acids and phosphonates preferably used are known chemical compounds which may be prepared, for example, by the Michaelis-Arbuzov reaction. They correspond, for example, to formula (I):

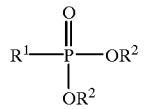

(I)

in which $R^1$ is an optionally substituted alkyl and/or alkenyl group containing 1 to 22 carbon atoms, preferably 2 to 18 carbon atoms and more preferably 6 to 12 carbon atoms and $R^2$ is hydrogen, an alkali metal and/or alkaline earth metal, ammonium, alkylammonium and/or alkanol-ammonium or an optionally substituted alkyl and/or alkenyl group containing 1 to 22, preferably 2 to 18 and more preferably 6 to 12 carbon atoms. Typical examples are optionally hydroxy-, nitrilo- and/or amino-substituted phosphonic acids such as, for example, ethyl phosphonic acid, nitrilotris-(methylenephosphonic acid), 1-amino- and 1-hydroxyalkane-1,1-diphosphonic acids. One preferred embodiment of the invention is characterized by the use of amine oxide phosphonic acids corresponding to formula (II):

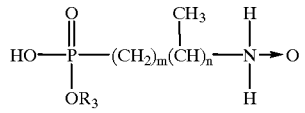

(II)

in which $R^3$ is hydrogen, a $(CH_2)_m(CHCH_3)_nNH_2O$ group or an alkali metal, m is a number of 1 to 4 and n has a value of 0 or 1. Amine oxide phosphonic acids-are builders or sequestrants which are marketed, for example, by Bozetto (Italy) under the name of Sequion®. They are produced by reacting aminophosphonic acids to form the amine oxide. According to the invention, both mono- and diamine oxides in the form of the phosphonic acids (or salts) corresponding to formula (II) may be used. Amine oxide phosphonic acids in which $R^3$ is hydrogen, m=3 and n=0 (amine oxide based on aminotrimethylene phosphonic acid) are preferably used.

Polyacrylic acid compounds are understood to be homopolymers of acrylic acid and methacrylic acid and esters thereof. Besides the acids, esters of the acids with alcohols containing 1 to 4 carbon atoms may also be polymerized. Polyacrylic acid compounds having a particularly advantageous stabilizing effect are present as alkali metal salts and have an average molecular weight in the range from 1,000 to 10,000 dalton and more particularly in the range from 4,000 to 6,000 dalton. A suitable modified polyacrylate is Norasol® 470 N (Rohm & Haas, Germany) which is a polyphosphonoacrylate with a molecular weight of 3,500 dalton.

Thickeners

The use of electrolytes is a very simple and inexpensive method of 5 adjusting viscosity. In one preferred embodiment of the invention, however, organic thickeners are used. Organic thickeners are, for example, polysaccharides, more particularly xanthan gum, guar guar, agar agar, alginates and tyloses, carboxymethyl cellulose and hydroxyethyl cellulose, also relatively high molecular weight polyethylene glycol monoesters and diesters of fatty acids, polyacrylates (for example Carbopols® [Goodrich] or Synthalens® [Sigma]), polyacrylamides, polyvinyl alcohol and polyvinyl pyrrolidone, aluminas such as, for example, Laponite® of Southern Clay Products or Zeothix® of Huber, surfactants such as, for example, ethoxylated fatty acid glycerides, esters of fatty acids with polyols such as, for example, pentaerythritol or trimethylol propane, narrow-range fatty alcohol ethoxylates or alkyl oligoglucosides, which may be added to the preparations in quantities of 0.1 to 2% by weight.

Surfactants

To support their cleaning performance, the preparations may additionally contain chlorine-stable surfactants such as, for example, alkyl sulfates, alkyl sulfonates, alkyl benzenesulfonates, xylene sulfonates, sarcosinates, taurides, isethionates, sulfosuccinates, betaines, sugar esters, fatty alcohol polyglycol ethers and fatty acid-N-alkyl glucamides. However, alkyl ether sulfates, ether carboxylates, amine oxides, alk(en)yl oligoglycosides and fatty acid salts are preferably used. The surfactants together generally make up from 1 to 15% by weight and preferably from 5 to 10% by weight of the preparations.

Alkyl ether sulfates are anionic surfactants which may be obtained by sulfation of alkyl polyglycol ethers and subsequent neutralization. Alkyl ether sulfates suitable for use in accordance with the invention correspond to formula (III):

$$R^4O—(CH_2CH_2O)_nSO_3X \quad (III)$$

in which $R^4$ is an alkyl group containing 12 to 18 and, more particularly, 12 to 14 carbon atoms, n is a number of 2 to 5 and, more particularly, 2 to 3 and X stands for sodium or potassium. Typical examples are the sodium salts of sulfates of the $C_{12/14}$ cocoalcohol +2,+2.3 and +3 EO adduct. The alkyl ether sulfates may have a conventional or narrow homolog distribution. The alkyl ether sulfates are preferably used in quantities of 1 to 8% by weight, preferably 1.5 to 6% by weight and more preferably 2 to 4% by weight, based on the preparation.

According to the invention, ether carboxylates or ether carboxlic acids prefra bly correspond formula (IV):

$$R[OCH_2CH_2]_u[O(CH_2)_xCH(R')(CH_2)_yCH(R'')(CH_2)_z]_v[OCH_2CH_2]_wOCH_2COOM \quad (IV)$$

in which

- R is a hydrocarbon radical containing 6 to 28 carbon atoms,
- u and v may be the same or different and stand for numbers of 0 to 30, u being 0 where v is 0,
- w is a number of 1 to 30, the sum of u+v+w being ≦30,
- x,y and z independently of one another are the numbers 0 or 1,
- R' nnand R" independently of one another represent hydrogen, methyl or ethyl, the sum of x+y+z being >0 where R'=R"=H,
- M is an alkali metal or alkaline earth metal (=ether carboxylate) or hydrogen (=ether carboxylic acid).

Ethercarboxylates corresponding to formula (IV) can be obtained by alkoxylation of alcohols ROH with ethylene oxide as sole alkoxide or with several alkoxides and subsequent oxidation. The sum u+v+w represents the total degree of alkoxylation of the ether carboxylate. Whereas, on a molecular level, the numbers u, v and w and the total degree of alkoxylation can only be integers, including zero, on a macroscopic level they are mean values in the form of broken numbers.

In formula (IV),

- R is linear or branched, acyclic or cyclic, saturated or unsaturated, aliphatic or aromatic, preferably a linear or branched, acyclic $C_{6-22}$ alkyl or alkenyl group or a $C_{1-22}$ alkyl phenyl group, more particularly a $C_{8-18}$ alkyl or alkenyl group or a $C_{4-16}$ alkyl phenyl group, more preferably a $CO_{10-16}$ alkyl group,
- u,v,w in the sum u+v +w is prieferably a number of 2 to 20, more preferably a number of 3 to 17 and most preferably a number of 5to 15,
- x,y,z in the sum x+y+z is preferably no greater than 2, more preferably no greater than 1 and most preferably 0,
- R' and R"are preferably hydrogen (=R'), methyl (=R") or methyl (=R'), hydrogen (=R") and
- M is, in particular, lithium, sodium, potassium, calcium or magnesium, of which potassium and especially sodium are preferred.

Preferred ether carboxylates are mixed adducts of propylene oxide (v >0;x=y=z=0;R'=H, R"=Me R'=Me, R"=H) and ethylene oxide (u=0 or u>0) corresponding to formula (IV-a)

$$R[OCH_2CH_2]_u[OCH(R')CH(R'')_z]_v[OCH_2CH_2]_wOCH_2COOM \quad (IV\text{-}a)$$

more particularly those in which u=O,R'=Me and R"=H corresponding to formula (IV-b):

$$R[OCH(CH_3)CH_2]_v[OCH_2CH_2]_wOCH_2COOM \quad (IV\text{-}b)$$

Since the formulations according to the invention are highly alkaline, the ether carboxylates may also be replaced by the ether carboxylic acids (M=H) which are neutralized in situ on introduction into the mixture. Accordingly, suitable ether carboxylates or ether carboxylic acids are, for example the following representatives referred to by their INCI names (INCI: nomenclature for raw materials according to the *International Cosmetic Ingredient Dictionary,* 7th Edition, published by the Cosmetic, Toiletry and Fragrance Association Inc. (CTFA), Washington D.C., USA): Butoxynol-5 Carboxylic Acid, Butoxynol-19 Carboxylic Acid, Capryleth-4 Carboxylic Acid, Capryleth-6 Carboxylic Acid, Capryleth-9 Carboxylic Acid, Ceteareth-25 Carboxylic Acid, Coceth-7 Carboxylic Acid, C9-11 Pareth-6 Carboxylic Acid, C11-15 Pareth-7 Carboxylic Acid, C12-13 Pareth-5 Carboxylic Acid, C12-13 Pareth-8 Carboxylic Acid, C12-13 Pareth-12 Carboxylic Acid, C12-15 Pareth-7 Carboxylic Acid, C12-15 Pareth-8 Carboxylic Acid, C14-15 Pareth-8 Carboxylic Acid, Deceth-7 Carboxylic Acid, Laureth-3 Carboxylic Acid, Laureth-4 Carboxylic Acid, Laureth-5 Carboxylic Acid, Laureth-6 Carboxylic Acid, Laureth-8 Carboxylic Acid Laureth-10 Carboxylic Acid, Laureth-11 Carboxylic Acid, Laureth-12 Carboxylic Acid, Laureth-13 Carboxylic Acid, Laureth-14 Carboxylic Acid, Laureth-17 Carboxylic Acid, Magnesium Laureth-11 Carboxylate, Sodium-PPG-6-Laureth-6-Carboxylate, Sodium PPG-8-Steareth-7 Carboxylate, Myreth-3 Carboxylic Acid, Myreth-5 Carboxylic Acid, Nonoxynol-5 Carboxylic Acid, Nonoxynol-8 Carboxylic Acid, Nonoxynol-10 Carboxylic Acid, Octeth-3 Carboxylic Acid, Octoxynol-20 Carboxylic Acid, Oleth-3 Carboxylic Acid, Oleth-6 Carboxylic Acid, Oleth-10 Carboxylic Acid, PPG-3-Deceth-2 Carboxylic Acid, Sodium Capryleth-2 Carboxylate, Sodium Capryleth-9 Carboxylate, Sodium Ceteth-13 Carboxylate, Sodium C9-11 Pareth-6 Carboxylate, Sodium C11-15 Pareth-7 Carboxylate, Sodium C12-13 Pareth-5 Carboxylate, Sodium C12-13 Pareth-8 Carboxylate, Sodium C12-13 Pareth-12 Carboxylate, Sodium C12-15 Pareth-6 Carboxylate, Sodium C12-15 Pareth-7 Carboxylate, Sodium C12-15 Pareth-8 Carboxylate, Sodium C14-15 Pareth-8

Carboxylate, Sodium Deceth-2 Carboxylate, Sodium Hexeth4 Carboxylate, Sodium Isostearetb-6 Carboxylate, Sodium Isostearetb-11 Carboxylate, Sodium Laureth-3 Carboxylate, Sodium Laureth4 Carboxylate, Sodium Laureth-5 Carboxylate, Sodium Laureth-6 Carboxylate, Sodium Laureth-8 Carboxylate Sodium Laureth-11 Carboxylate, Sodium Laureth-12 Carboxylate, Sodium Laureth-13 Carboxylate, Sodium Laureth-14 Carboxylate, Sodium-Laureth-17 Carboxylate, Sodium -Trudeceth-3 Carboxylate, Sodium Trideceth-6 Carboxylate, Sodium Trideceth-7 Carboxylate, Sodium Trideceth-8 Carboxylate, Sodium Trideceth-12 Carboxylate, Sodium Undeceth-5 Carboxylate, Trideceth-3 Carboxylic Acid, Trideceth4 Carboxylic Acid, Trideceth-7 Carboxylic acid, Trideceth-15 Carboxylic Acid, Trideceth-19 Carboxylic Acid, Undeceth-5 Carboxylic Acid.

Particularly preferred ether carboxylates are the ethoxylates (u=v=0) corresponding to formula (IV-c):

$$R[OCH_2CH_2]_wOCH_2COOM \quad \text{(IV-c)}$$

in which R, w and M are as defined for formula (IV), R preferably being a C10-16 alkyl group, w preferably being a number of 3 to 17 and M preferably being sodium. These ethoxylates are, in particular, the sodium lauryl ether carboxylates with a degree of ethoxylation w of 5 to 15, for example Sodium Laureth-6 Carboxylate (w=6) or Sodium Laureth-11 Carboxylate (w=11).

The ether carboxylates may have a conventional or narrow homolog distribution.

Amine oxides are also known compounds which are occasionally classified as cationic surfactants, but generally as nonionic surfactants. They are produced by oxidation of tertiary fafty amines, which normally have either one long and two short alkyl chains or two short and one long alkyl chain, in the presence of hydrogen peroxide. The amine oxides suitable as surface-active ingredients in accordance with the present invention correspond to formula (V):

(V)

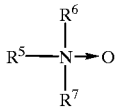

in which $R^5$ is a linear or branched alkyl group containing 12 to 18 carbon atoms and $R^6$ and $R^7$ independently of one another have the same meaning as $R^5$ or represent an optionally hydroxysubstituted alkyl group containing 1 to 4 carbon atoms. Amine oxides corresponding to formula (V) in which $R^5$ and $R^6$ represent $C_{12/14}$ or $C_{12/18}$ cocoalkyl groups and $R^7$ represents a methyl group or a hydroxyethyl group, are preferably used. Amine oxides corresponding to formula (V), in which $R^5$ represents a $C_{12/14}$ or $C_{12/18}$ cocoalkyl group and $R^6$ and $R^7$ represent a methyl or hydroxyethyl group, are also preferred. The amine oxides are preferably used in quantities of 1.5 to 6% by weight and preferably 2 to 4% by weight, based on the preparation.

Alkyl and alkenyl oligoglycosides are known nonionic surfactants which correspond to formula (VI):

$$R^8O—[G]_p \quad \text{(VI)}$$

in which $R^8$ is an alkyl and/or alkenyl radical containing 4 to 22 carbon atoms, G is a sugar unit containing 5 or 6 carbon atoms and p is a number of 1 to 10. The alkyl and/or alkenyl oligoglycosides, which are also suitable as surface-active ingredient, may be derived from aldoses or ketoses containing 5 or 6 carbon atoms, preferably glucose. Accordingly, the preferred alkyl and/or alkenyl oligoglycosides are alkyl and/or alkenyl oligoglucosides. The index p in general formula (VI) indicates the degree of oligomerization (DP), i.e. the distribution of mono- and oligoglycosides, and is a number of 1 to 10. Whereas p in a given compound must always be an integer and, above all, may assume a value of 1 to 6, the value p for a certain alkyl oligoglycoside is an analytically determined calculated quantity which is generally a broken number. Alkyl and/or alkenyl oligo-glycosides having an average degree of oligomerization p of 1.1to 3.0 are preferably used. Alkyl and/or alkenyl oligoglycosides having a degree of oligomerization of less than 1.7 and, more particularly, between 1.2 and 1.4 are preferred from the applicational point of view. The alkyl or alkenyl radical $R^8$ may be derived from primary alcohols containing 4 to 11 and preferably 8 to 10 carbon atoms. Typical examples are butanol, caproic alcohol, caprylic alcohol, capric alcohol and undecyl alcohol and the technical mixtures thereof obtained, for example, in the hydrogenation of technical fatty acid methyl esters or in the hydrogenation of aldehydes from Roelen's oxosynthesis. Alkyl oligoglucosides having a chain length of $C_8$ to $C_{10}$ (DP=1 to 3), which are obtained as first runnings in the separation of technical $C_{8-18}$ coconut oil fatty alcohol by distillation and which may contain less than 6% by weight of $C_{12}$ alcohol as an impurity, and also alkyl oligoglucosides based on technical $C_{9/11}$ oxoalcohols (DP=1 to 3) are preferred. In addition, the alkyl or alkenyl radical $R^8$ may also be derived from primary alcohols containing 12 to 22 and preferably 12 to 14 carbon atoms. Typical examples are lauryl alcohol, myristyl alcohol, cetyl alcohol, palmitoleyl alcohol, stearyl alcohol, isostearyl alcohol, oleyl alcohol, elaidyl alcohol, petroselinyl alcohol, arachyl alcohol, gadoleyl alcohol, behenyl alcohol, erucyl alcohol, brassidyl alcohol and technical mixtures thereof which may be obtained as described above. Alkyl oligoglucosides based on hydrogenated $C_{12/14}$ cocoalcohol with a DP of 1 to 3 are preferred. The glycosides are preferably used in quantities of 1.5 to 6% by weight and more preferably in quantities of 2 to 4% by weight, based on the preparation.

The preparations according to the invention may contain as further surfactants fatty acid salts corresponding to formula (VII):

$$R^9CO—OX \quad \text{(VII)}$$

in which $R^9CO$ is an acyl group containing 12 to 22carbon atoms and X is an alkali metal. Typical examples are the sodium and/or potassium salts of lauric acid, myristic acid, palmitic acid, palmitoleic acid, stearic acid, isostearic acid, oleic acid, elaidic acid, petroselic acid, linoleic acid, linolenic acid, elaeostearic acid, arachic acid, gadoleic acid, behenic acid and erucic acid and the technical mixtures thereof obtained in the pressure hydrolysis of technical fats and oils. Salts of technical cocofatty and tallow fatty acids are preferably used. Since the formulations according to the invention are highly alkaline, the salts may also be replaced by the acids which are neutralized in situ on introduction into the mixture. Those preparations according to the invention which are required to be particularly low-foaming preferably contain fatty acid salts as an optional component. The soaps are preferably used in quantities of 1.5 to 6% by weight and more preferably in quantities of 2 to 4% by weight, based on the preparation.

Commercial Applications

The preparations according to the invention are generally aqueous with a non-aqueous component of, preferably, 5 to 35% by weight and, more preferably, 8 to 15% by weight and are particularly suitable for the treatment of flat textile materials such as, for example, yarns, fabric webs and, in particular, textiles. They are normally used at low temperatures, i.e. at cold-wash temperatures (ca. 15 to 25° C.). Not only are the preparations distinguished by excellent stain removal, they also reliably prevent the deposition of lime and metal traces on the fibers and thus also prevent incrustation and yellowing. Although the actual use of the preparations is directed to the removal of stains during washing, they are also suitable in principle for other applications in which hypochlorite solutions are used, for example for the cleaning and disinfection of hard surfaces.

The preparations according to the invention may additionally contain fragrances, dyes and pigments in total quantities of 0.01to 5% by weight, based on the preparation. Typical examples of suitable perfumes stable to active chlorine are: citronellol (3,7-dimethyl-6-octen-1-ol), dimethyl octanol (3,7-dimethyl-1-octanol), hydroxycitronellol (3,7-dimethyloctane-1,7-diol), mugol (3,7-dimethyl-4,6-octatrien-3-ol), myrcenol (2-methyl-6-methylene-7-octen-2-ol), tetrahydromyrcenol (THM, 2,6-dimethyloctan-2-ol), terpinolene (p-mentho-1,4-(8)-diene), ethyl-2-methyl butyrate, phenyl propyl alcohol, galaxolide (1,3,4,6,7,8-hexahydro-4,6,6,7,8,8-hexamethyl cyclopental-2-benzopyran), tonalide (7-acetyl-1,1,3,4,4,6-hexamethyl tetrahydronaphtha-lene), rose oxide, linalol oxide, 2,6-dimethyl-3-octanol, tetrahydroethyl linalool, tetrahydroethyl linalyl acetate, o-sec.-butyl cyclohexyl acetate and isolone diphorenepoxide and also isoborneal, dihydroterpineol, isobomyl acetate, dihydroterpenyl acetate). Other suitable perfumes are the substances mentioned columns 3 and 4 of European patent application EP 0622451 A1 (Procter & Gamble). Suitable pigments are inter alia green chlorophthalocyanines (Pigmosol® Green, Hostaphine® Green) or yellow Solar Yellow BG 300 (Sandoz). The preparations according to the invention are prepared by stirring. The product obtained may optionally be decanted or filtered to remove foreign bodies and/or agglomerates. In addition, the preparations have a viscosity above 100 and preferably above 200 mPas, as measured at 20° C. in a Brookfield viscosimeter (spindle 1, 10 r.p.m.).

Examples

On the one hand Tinopal® CBS-X capsules and on the other hand the pure optical brightener were added to various hypochlorite solutions which were then introduced into dark bottles and stored at 25° C. Quantities of 100 ml of the solutions were visually evaluated immediately after their preparation and after storage for 2 weeks and 4 weeks, subsequently poured into glass beakers and then treated for 1minute with a magnetic stirrer on a low-speed setting. Soiled fabrics were then treated with the bleaching solutions. The yellowing of the fabrics was photometrically determined, the starting value of the soiled fabrics serving as standard (100%). The water hardness of the liquor was 1000 ppm $CaCl_2$. The liquor ratio (fabric: water) was 1:50, the contact time was 30 mins. at a temperature of 40° C. The results are set out in Table 1. Examples 1 to 3 correspond to the invention while Examples C1 and C2 are intended for comparison.

TABLE 1

Composition of the bleaching agents and the yellowing of fabrics

| Composition | 1 | 2 | 3 | C1 | C1 |
|---|---|---|---|---|---|
| Sodium hypochlorite | 4.0 | 1.0 | 4.0 | 4.0 | 4.0 |
| Sodium hydroxide | 0.7 | 1.0 | 0.9 | 0.7 | 0.9 |
| Cocofatty alcohol + 2EO sulfate Na salt | — | 2.0 | 1.0 | — | 1.0 |
| Lauryl dimethyl amine oxide | — | 1.0 | — | — | 2.0 |
| Sodium silicate[1)] | 0.95 | 0.1 | — | 0.95 | — |
| Amine oxide phosphonic acid[2)] | 0.1 | — | — | 0.1 | — |
| Polyacrylate[3)] | 1.0 | 1.0 | 1.0 | 1.0 | 1.0 |
| Polyacrylate[4)] | 0.05 | — | — | 0.05 | — |
| Microcapsules (Lipotex)[5)] | 0.3 | 0.3 | 0.3 | — | — |
| THM | — | 0.02 | — | — | 0.02 |
| Tinopal ® CBS-X | — | — | — | 0.3 | 0.3 |
| Water | | | to 100 | | |
| Yellowing [%-rel] | | | | | |
| Immediately | 65 | 66 | 65 | 58 | 59 |
| After storage for 2 weeks | 66 | 68 | 68 | 68 | 71 |
| After storage for 4 weeks | 69 | 70 | 70 | 81 | 83 |
| Optical impression | Homo-geneous | Homo-geneous | Homo-geneous | Clear | Clear |

[1)]modulus 2.0;
[2)]Sequion ® (Bozetto);
[3)]Carbopol 497 (Goodrich);
[4)]Norasol ® LMW 45 N (sodium salt, MW = 4500, NorsoHaas);
[5)]filling, 90% by weight Tinopal ® CBS-X (4,4'-bis-(2-sulfostyryl)-biphenyl disodium salt), shell material: sodium alginate The preparations according to the invention containing the microencapsulated optical brightener are homogeneous even after storage for 4 weeks, i.e. the capsules have not sedimented. Whereas the comparison formulations, despite their 30% higher Tinopal® CBS-X content, have a distinctly reduced performance after only 2 weeks due to the chemical decomposition of the optical brightener, an adequate quantity of optical brightener is released, even after storage, when the preparations according to the invention are exposed to a mechanical load. Accordingly, the microencapsulation is suitable for preventing chemical decomposition.

What is claimed is:

1. An active chlorine composition comprising an active chlorine and an optical brightener, wherein said optical brightener is in the form of a microcapsule, wherein said microcarsule comprises a shell substance comprising a natural or semisynthetic material.

2. The active chlorine composition of claim 1 comprising 0.5 to 10 percent by weight of an alkali metal hypoclorite.

3. The active chlorine composition of claim 2 comprising 3 to 7 percent by weight of an alkali metal hypoclorite.

4. The active chlorine composition of claim 3 comprising 4 to 6 percent by weight of an alkali metal hypoclorite.

5. The active chlorine composition of claim 1 further comprising 0.5 to 2 percent by weight of an alkali metal hydroxide.

6. The active chlorine composition of claim 5 comprising 0.7 to 1.2 percent by weight of an alkali metal hydroxide.

7. The active chlorine composition of claim 1 comprising 0.1 to 10 percent by weight of said microcapsule.

8. The active chlorine composition of claim 7 comprising 0.2 to 8 percent by weight of said microcapsule.

9. The active chlorine composition of claim 8 comprising 0.5 to 6 percent by weight of said microcapsule.

10. The active chlorine composition of claim 1 wherein said microcapsule comprises a natural or seiisynthetic shell substance selected from the group consisting of gum arabic, agar, agarose, maltodextrins, alginic acid, alginates, fats and fatty acids, cetyl alcohol, collagen, chitosan, lecithin, gelatin, albumin, shellac, polysaccharides, celluloses, cellulose esters, cellulose ethers, starch ethers, starch esters and mixtures thereof.

11. The active chlorine composition of claim 1 wherein the diameter of said microcapsule is from 0.01 to 10,000 micrometers along the largest spatial dimension.

12. The active chlorine composition of claim 11 wherein the diameter of said microcapsule is from 0.1 to 7 millimeters.

13. The active chlorine composition of claim 12 wherein the diameter of said microcapsule is from 0.4 to 5 millimeters.

14. The active chlorine composition of claim 11 wherein the diameter of said microcapsule is from 20 to 500 nanometers.

15. The active chlorine composition of claim 14 wherein the diameter of said microcapsule is from 50 to 200 nanometers.

16. The active chlorine composition of claim 1 wherein said microcapsule comprises 1 to 95 percent by weight of optical brightener.

17. The active chlorine composition of claim 15 wherein said microcapsule comprises 1 to 75 percent by weight of optical brightener.

18. The active chlorine composition of claim 17 wherein said microcapsule comprises 10 to 60 percent by weight of optical brightener.

19. The active chlorine composition of claim 18 wherein said microcapsule comprises 25 to 50 percent by weight of optical brightener.

20. The active chlorine composition of claim 1 wherein said microcapsule further comprises a blue dye.

21. The active chlorine composition of claim 1 further comprising sequestrants, thickeners, or mixtures thereof.

22. The active chlorine composition of claim 1 having a Brookfield viscosity above 100 mPas at 20° C., spindle 1 at 10 rpm.

23. The active chlorine composition of claim 21 having a Brookfield viscosity above 200 mPas at 20° C., spindle 1 at 10 rpm.

* * * * *